US008950997B2

(12) United States Patent
Battersby et al.

(10) Patent No.: US 8,950,997 B2
(45) Date of Patent: Feb. 10, 2015

(54) METHOD AND APPARATUS FOR SUPPORTING A LOAD

(75) Inventors: James Marvin Battersby, Aberdeenshire (GB); David John Down, Burnham-on-Crouch (GB); Julek Romuald Tomas, Aberdeenshire (GB)

(73) Assignee: Subsea 7 Limited, Sutton (GB)

( * ) Notice: Subject to any disclaimer, the term of this patent is extended or adjusted under 35 U.S.C. 154(b) by 606 days.

(21) Appl. No.: 13/138,169

(22) PCT Filed: Jan. 14, 2010

(86) PCT No.: PCT/EP2010/050388
§ 371 (c)(1),
(2), (4) Date: Feb. 29, 2012

(87) PCT Pub. No.: WO2010/081847
PCT Pub. Date: Jul. 22, 2010

(65) Prior Publication Data

US 2012/0156003 A1 Jun. 21, 2012

(30) Foreign Application Priority Data

Jan. 16, 2009 (GB) ..... 0900763.4

(51) Int. Cl.
*B63B 27/00* (2006.01)
*B63B 35/00* (2006.01)
(Continued)

(52) U.S. Cl.
CPC . *B66C 1/66* (2013.01); *B63B 27/10* (2013.01); *B66C 1/34* (2013.01); *B66C 23/52* (2013.01)
USPC ..... 414/137.7; 414/137.5; 414/142.8; 254/335; 254/4 R

(58) Field of Classification Search
CPC ..... B63B 27/00; F16L 1/202; F16L 1/207; F16L 1/235
USPC ..... 414/137.7, 137.5, 137.8, 141.3, 141.4, 414/142.6, 142.7, 142.8; 254/334–336, 254/278, 394, 4 R, 277; 405/154.1, 158, 405/173; 14/51
See application file for complete search history.

(56) References Cited

U.S. PATENT DOCUMENTS 3,258,249 A 6/1966 Williams
3,687,418 A 8/1972 Halvorsen
(Continued)

FOREIGN PATENT DOCUMENTS

DE 202 676 9/1983
GB 1 253 375 11/1971
(Continued)

*Primary Examiner* — Saul Rodriguez
*Assistant Examiner* — Lynn Schwenning
(74) *Attorney, Agent, or Firm* — Levy & Grandinetti

(57) ABSTRACT

A lifting block and a method of using it for supporting a load from a first lifting device or sharing the load between the first lifting device and a second lifting device, particularly for use on a vessel and deep water applications, are disclosed. The lifting block, with at least one sheave, has first and second connection elements associated with it. In one arrangement (single fall) a lifting wire or rope is fed around the sheave and terminated in an end stop which also provides the first connection element. When the first lifting device is operated alone, the end stop rests on the block. When the second connection element, secured to the lifting wire or rope of a second lifting device, is joined to the first connection element the load is snared between the two lifting devices which can then be operated in unison to position the load at a required, deeper position.

20 Claims, 11 Drawing Sheets

(51) Int. Cl.

| | |
|---|---|
| ***B66C 1/66*** | (2006.01) |
| ***B63B 27/10*** | (2006.01) |
| ***B66C 1/34*** | (2006.01) |
| ***B66C 23/52*** | (2006.01) |

(56) References Cited

U.S. PATENT DOCUMENTS

| | | | | |
|---|---|---|---|---|
| 7,882,794 | B2 | 2/2011 | Baylor et al. | |
| 2005/0191165 | A1 * | 9/2005 | Willis et al. | 414/803 |
| 2007/0177944 | A1 * | 8/2007 | Smith et al. | 405/169 |
| 2009/0261052 | A1 * | 10/2009 | Vasstrand | 212/270 |
| 2010/0189541 | A1 * | 7/2010 | Laenge | 414/803 |

FOREIGN PATENT DOCUMENTS

| | | | | |
|---|---|---|---|---|
| GB | 1 434 143 | | 5/1976 | |
| GB | 2 229 403 | | 9/1990 | |
| GB | 2 266 694 | | 11/1993 | |
| GB | 2 363 362 | | 12/2001 | |
| JP | 2001-200955 | | 7/2001 | |
| WO | WO2007-145503 | | 12/2007 | |
| WO | WO2008-100943 | | 8/2008 | |
| WO | WO 2009002142 | * | 12/2008 | B66C 13/18 |
| WO | WO 2009/005359 | | 1/2009 | |
| WO | WO 2009/094739 | | 8/2009 | |

* cited by examiner

METHOD AND APPARATUS FOR SUPPORTING A LOAD

This Application is the U.S. National Phase of International Application Number PCT/EP2010/050388, filed on Jan. 14, 2010, which claims priority to Great Britain Application Number 0900763.4, filed on Jan. 16, 2009.

This invention relates to a load supporting method and apparatus particularly but not exclusively for use in connection with lifting equipment employed in the oil industry.

Subsea activities of the oil industry are taking it into even deeper water and consequently lifting of heavy equipment and pipes has to be accomplished at a much greater depth than hitherto. Such depths are generally around 3,000 m or more.

Such oil industry activities may include positioning a load on the sea floor from a floating vessel, lift and shift operations off the sea floor, where a heavy load has previously been laid or wet stored on the sea floor to be subsequently lifted and moved to a new location without being taken out of the water, or positioning an unlaid end portion of a pipe that is being laid on the sea floor, or recovering to the floating vessel the end of the pipe lying on: the sea floor, in other words, the lay down, abandonment and recovery of loads, such as oil conveying pipes, pipeline end terminations (PLETs), manifolds and the like, particularly during or at the end of the process of laying such pipes from a pipe laying vessel onto the sea floor.

The term "abandonment and recovery" is often abbreviated to "A&R".

Most of the lifting equipment currently in use on offshore construction vessels employs steel wires as a lifting medium. To handle the loads involved (250 tonnes or more) these wires are necessarily large and heavy. The limitation with such wire is its self weight, which can have significant effect on the available lift capacity of a crane or hoist. In an extreme case, the useful capacity of a lifting device can be reduced to zero.

This problem can be overcome by using synthetic fibre ropes which weight little or nothing when immersed in water, but they typically require specially designed winches and, being more "elastic" than steel, can introduce problems of resonance. As indicated above, the problem can also be solved by employing a pennant wire in the rigging train to increase the depth range.

Reference is made to U.S. Pat. No. 3,258,249, which discloses a multi-speed pulling apparatus having a triangular flat plate, to respective locations, of which sheaved hoisting blocks are connected by removable pins and from a third location of which a cargo hook is suspended for carrying a load or cargo. By removing one or the other pin to detach one or the other hoisting block, the load carrying capacity of the pulling apparatus is reduced, but its operating speed is increased.

The present invention is aimed at extending the working depth of existing lifting equipment on a vessel without necessarily requiring the use of fibre ropes or having to introduce pennant wires.

According to one aspect of the present invention there is provided a method for use in supporting a load, comprising the steps of: providing a lifting block and associated first and second connection elements; supporting the first connection element on the lifting block by means of a lifting wire or rope of a first lifting device whereby a load attached to the lifting block can be raised or lowered by the first lifting device alone; attaching the load to the lifting block; operating the first lifting device to cause the load to reach a predetermined level; attaching the second connection element to a lifting wire or rope of a second lifting device and operating the second lifting device to cause the second connection element to approach the first connection element; joining the first and second connection elements whereby the load is supported by and shared between the first and second lifting devices; and operating the first and second lifting devices in unison to dispose the load at a required position.

The method may be used for supporting a said load from a floating vessel, the first and second lifting devices being spaced apart on the vessel, the predetermined level being at a first depth under the vessel, and the required position being at a greater depth than the first depth.

The method may include, following the joining step, the step of adjusting the lengths of the lifting wires or ropes of the first and second lifting devices to cause a predetermined displacement between the lifting block and the first connection element.

The first lifting device may be a single fall device and the lifting block may include a sheave, and the method may include the steps of feeding the lifting wire or rope of the first lifting device around the sheave and terminating the lifting wire or rope of the first lifting device to the first connection element which, when the load is lifted by the first lifting device alone, forms an end stop which will bear against the lifting block.

The end stop may bear against cheek plates of the sheave.

The first lifting device may be a twin fall device and the lifting block may have first and second sheaves and the first connection element may have a respective sheave, the lifting wire or rope of the first lifting device being fed around the first sheave of the lifting block, around the respective sheave of the first connection element, around the second sheave of the lifting block and secured back at the first lifting device, and when the load is lifted by the first lifting device alone the first connection element rests on the lifting block.

The first connection element may bear against cheek plates of both the first and second sheaves of the lifting block.

The method may include the step of disposing a heave compensator in the lifting wire or rope of the second lifting device.

The method may involve a twin fall device for the second lifting device and comprise a further lifting block around a sheave of which the lifting wire or rope of the second lifting device is passed and secured back at the second lifting device, the second connection element being carried by the further lifting block.

The method may include joining the first and second connector elements by use of a remotely operated vehicle, ROV.

The method may further include the step of disposing a neutrally buoyant strop, which is pre-installed on the lifting wire or rope of the second lifting device, between the lifting wire or rope of the second lifting device and the first connector element by the ROV prior to said joining step whereby to facilitate operation of the ROV for said joining step.

According to another aspect of the present invention there is provided a lifting block adapted to support a load from a first lifting device alone or from the first lifting device and a second lifting device together, in combination with a first connection element and a second connection element, the first connection element being adapted to be supported on the lifting block by a lifting wire or rope of the first lifting device in use of the lifting block, for supporting the load by the first lifting device alone, and the first connection element being adapted to be connectable to the second connection element, thereby connecting the second connecting element to the lifting block, the second connecting element, in use of the lifting block, being attached to a lifting wire or rope of the second lifting device, the first connection element being connected to the second connection element in, use of the lifting block for supporting the load by the first and second lifting devices together.

The lifting block for a single fall first lifting device may include a single sheave and the first connection element may be adapted to terminate the lifting wire or rope of the first lifting device, fed around the sheave, and form an end stop adapted to bear against the lifting block when the load is supported by the first lifting device alone.

The lifting block may include cheek plates associated with the sheave and the end stop may be adapted to bear against the cheek plates when the load is supported by the first lifting device alone.

The lifting block for a twin fall first lifting device may include first and second sheaves and the first connection element may have a respective sheave, and in use the lifting wire or rope of the first lifting device may be fed around the first sheave of the lifting block, around the respective sheave of the first connection element, around the second sheave of the lifting block and be secured back at the first lifting device, and wherein the first connection element in the twin fall form may be adapted to bear against the lifting block when the load is supported by the first lifting device alone.

The first connection element in the twin fall form may be adapted to rest on cheek plates of both the first and second sheaves of the lifting block. Additional guidance and support features can be incorporated to ensure a correct resting attitude of the respective sheave of the first connection element.

The lifting block may be for the case where the second lifting device is a twin fall device and comprises a further lifting block around a sheave of which in use the lifting wire or rope of the second lifting device is passed and secured back at the second lifting device. The second connection element may be carried by the further lifting block.

The first connection element may comprise a female connector for engagement with a male connector comprising the second connector element carried by the lifting wire or rope of the second lifting device, or other type of ROV operable connector well known in the art.

To enable a better understanding of the invention, and to show how the same may be carried into effect, reference will now be made, by way of example only, to the accompanying drawings, in which.

Most construction and pipe lay vessels have two or more heavy lifting devices on board, for example one or more cranes and/or A&R facilities.

By attaching two lifting devices to a load, the load in each lifting wire is halved. This means that half of the load weight becomes available as additional usable lifting wire weight, and the depth range of the combination can be extended beyond that of a single lifting device.

Figure 1A:
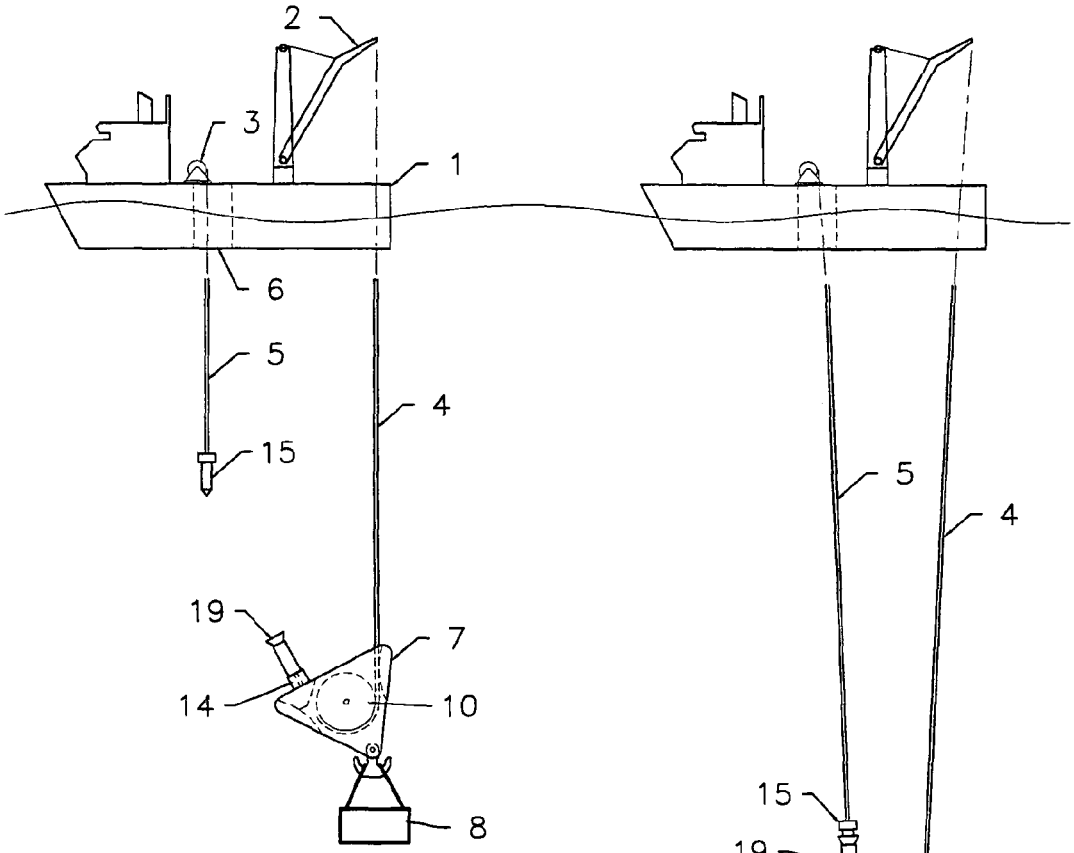
FIG. 1A illustrates a load suspended from a vessel by a single lifting wire.

FIG. 1A illustrates schematically a vessel 1 having a crane comprising a first lifting device, an A&R winch 3 comprising a second lifting device, a lifting wire 4 from the crane 2, and an A&R winch wire 5 from the winch 3, which is illustrated as passing through a moon pool 6, but is not limited to such an arrangement. Also illustrated are a lifting block 7 and a load 8 which may comprise a piece of equipment to be taken from the deck of the vessel and lowered to the sea bed, or in conjunction with A&R operations, a pipe to be lowered to or raised from the sea bed, or a vertical pipe riser system which may be installed/suspended vertically from a support structure.

Figure 1B:
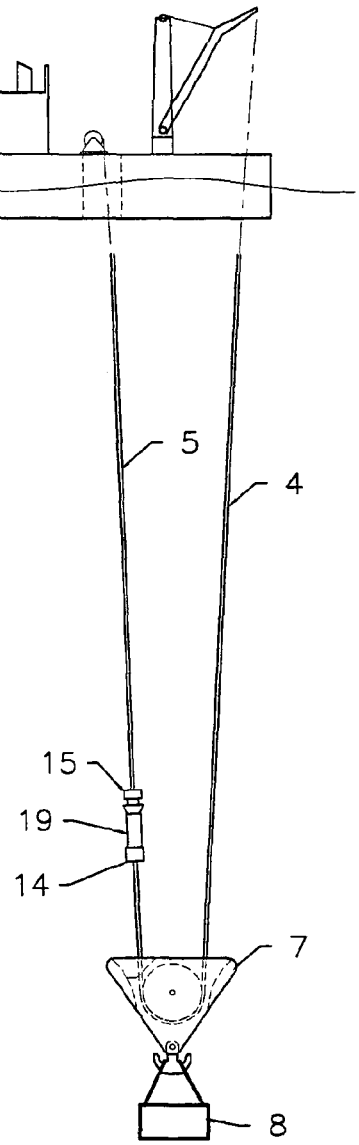
FIG. 1B illustrates the load suspended by two lifting wires.

By attaching two lifting devices to a load, the load in each lifting wire is halved. FIG. 1B illustrates the use of the lifting wire 4 and the A&R winch wire 5 to support the load 8. Using the two wires and two lifting devices means that half of the load weight becomes available as additional usable lifting wire weight, and the depth range of the combination can be extended beyond that of a single lifting device.

For example, when considering a single fall crane 2, the total load in the crane wire 4 for a given lift is the weight lifted plus the weight of the crane wire between the crane boom and the load. Such cranes are typical equipment aboard offshore construction vessels, and have a relatively high capacity as well as a substantial effective reach, for transferring objects around the deck of construction vessel, and placing and recovering objects from the sea floor and for loading items onto and unloading items from the vessel.

The rated capacity of a crane (whatever the.number of falls) is the allowable load applied to the crane boom by the sum of the loads in the lifting wires. In the case of the single fall arrangement, the load applied to the crane boom is therefore equal to the weight of the load lifted plus the weight of the single lifting wire between the boom and the load. These two weights added together should not therefore be allowed to exceed the rated capacity of the crane. From this it is possible to calculate the maximum depth that can be safely attained by a crane of known capacity and wire weight.

For example: if the nominal rated capacity ($W_c$) of the primary lift system such as a crane is 200 tonne, the lifting wire weight ($W_w$) is 40 kg/metre, and the load handled is 100 tonne ($W_L$), then when the load reaches the maximum allowable at the crane boom, the depth $D_{1max}$ (metres) can be deduced from the fact that the wire weight ($=40\times D_{1max}$) and the load weight ($=100\times1000$) and that both added together must not exceed the crane rated capacity ($=200\times1000$). From this the maximum depth $(D_{1max})=((200-100)\times1000)\div40=2500$ m.

If at this point the weight of the suspended load can be shared with another (secondary) lifting system (such as an A&R winch), then the effective weight of the suspended load acting on the crane boom is halved and $D_{2max}$ now ={[200−(100/2)]×1000}÷40=3750 m. This gives an increase of 1250 m operating depth. The weight of the additional wire being 40×1250=50000 kg=50 tonne—i.e. the reduction in the load acting on the crane boom due to the additional lift provided by a second hoist.

In very general terms therefore: the maximum working depth of a primary single fall lift system ($D_{max}$)=($W_c$−$W_L$)÷$W_w$ from which it can be seen that a reduction in $W_L$—e.g. by sharing the load with an additional secondary lift system—gives an increase in the maximum allowable depth. This increase being equal to the resulting reduction in the load on the crane boom divided by the primary lift system wire weight per unit length.

This arrangement can also be used with a multi-fall crane wire system, with an increase in depth commensurate with the number of falls.

It should be noted that whilst this arrangement does increase the crane operating depth, it does not increase the weight that a given crane can handle. This is because the load will first have to be lifted overboard by this crane when operating on its own.

The load sharing features can be utilized with fibre rope technology, which has the advantage of being significantly lighter in water than wire.

An embodiment of lifting block according to the invention and comprising a single fall version will now be described with reference to FIGS. 2 to 4.

The lifting block 7 enables the load sharing referred to above and has a built in sheave 10. It is referred to in the following as a Dual Suspension Lifting Block (DSLB).

The block carries a hook 25 of a hinged and swivelling type to ensure even load distribution.

Figure 2B:
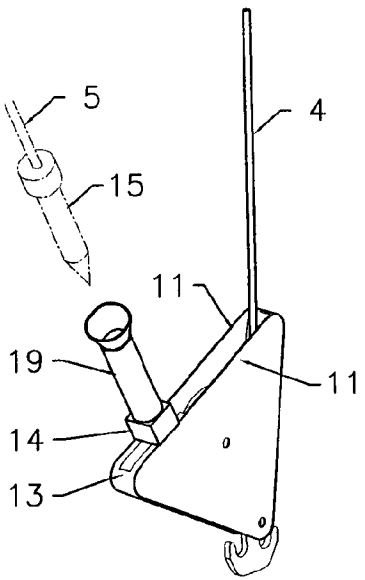
FIG. 2B shows a three-dimensional detail.
Figure 2A:
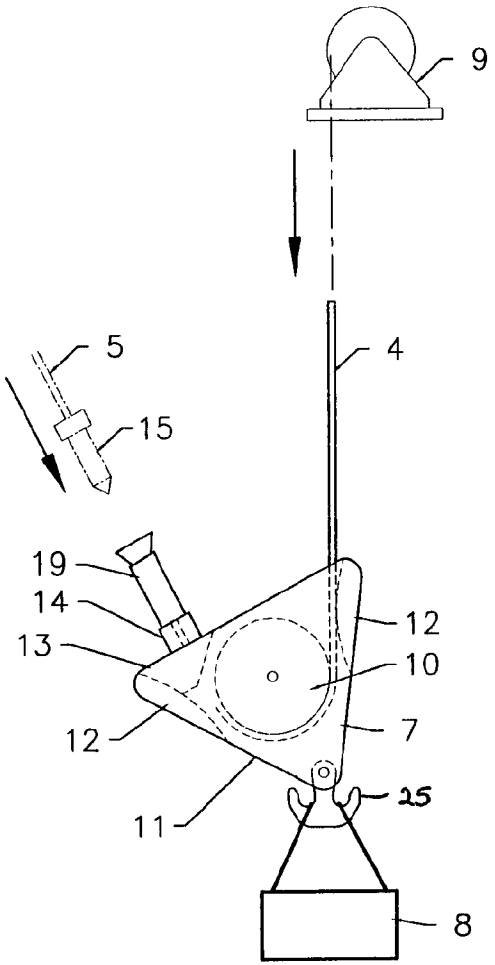
FIG. 2A shows in more detail a lifting block and connection elements, for a single fall crane lifting arrangement, according to the present invention which is illustrated in FIG. 1A.

The sheave 10 is mounted between sheave block cheek plates 11, as can be seen from FIGS. 2A and 2B between which are also provided suitably shaped wire guides 12 and a sheave block shoulder 13 for a lifting wire end stop 14.

The lifting wire of the first lifting device, that is crane wire 4, is fed into one side of the block 7, passes around the sheave 10 and is terminated in the lifting wire end stop 14 which also provides one half (first connection element 19) of a connector, the other half (second connection element 15) of which is attached to the lifting wire of a second lifting device, namely the A&R winch wire 5. When the load is taken solely by the lifting wire 4 the lifting wire end stop 14 bears against the shoulder 13 of the sheave block and the cheek plates 11, as is particularly apparent in FIG. 23, and the arrangement is designed in order to take the full crane load.

When the block is suspended from the first lifting device (the crane) alone then, because the wire comes out from one side, the block 7 hangs at an angle as illustrated in FIG. 2A with the load 8 suspended beneath it. The wire guides 12 are controlled radius wire guides provided on the cheek plates 11 to maintain the lifting wire bend within correct limits, whilst also keeping it within the confines of the lifting block (DSLB). A second connection element 15 is fitted to the free end of the lifting wire of the secondary lifting device, for example the A&R wire, as indicated by dotted lines in FIGS. 2A and 2B.

The first connection element 19 is particularly illustrated as a female connector and the second connection element 15 is particularly illustrated as a male connector element but reverse arrangements and other forms of connector can be used.

Figure 3B:
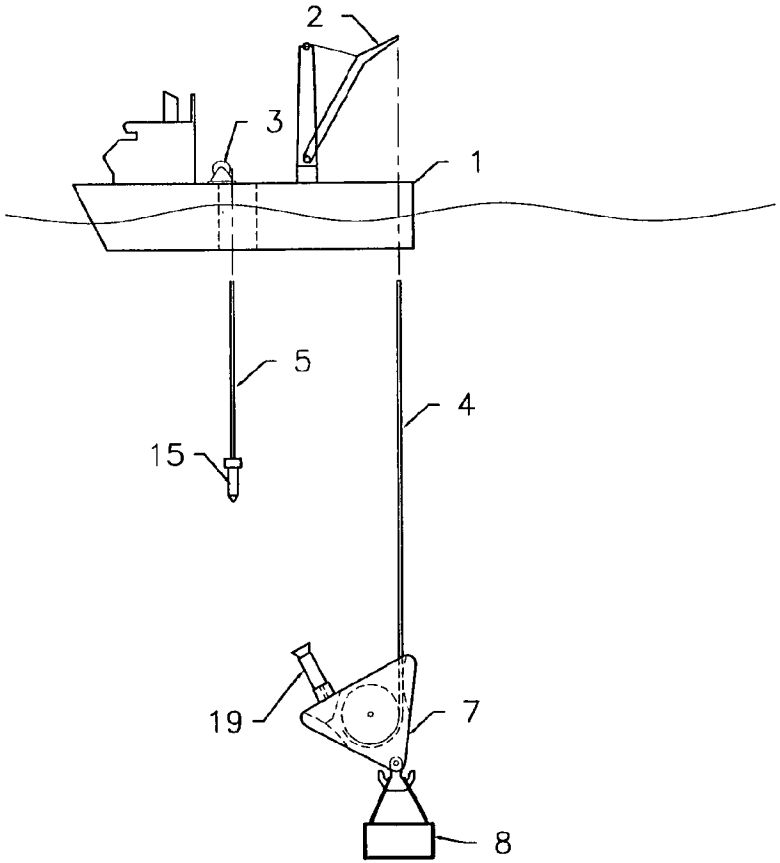
FIGS. 3A, 3B, 3C and 3D show successive stages in the process of a load being lifted off the deck of a vessel using a crane as a first lifting device and subsequent attachment of an A&R wire to the load.
Figure 3A:
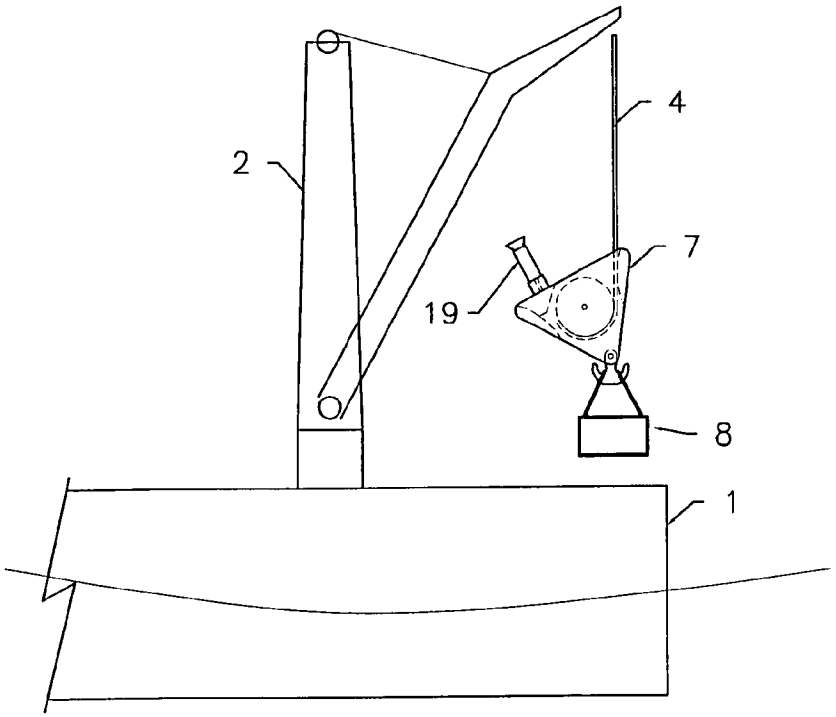
Figure 3D:
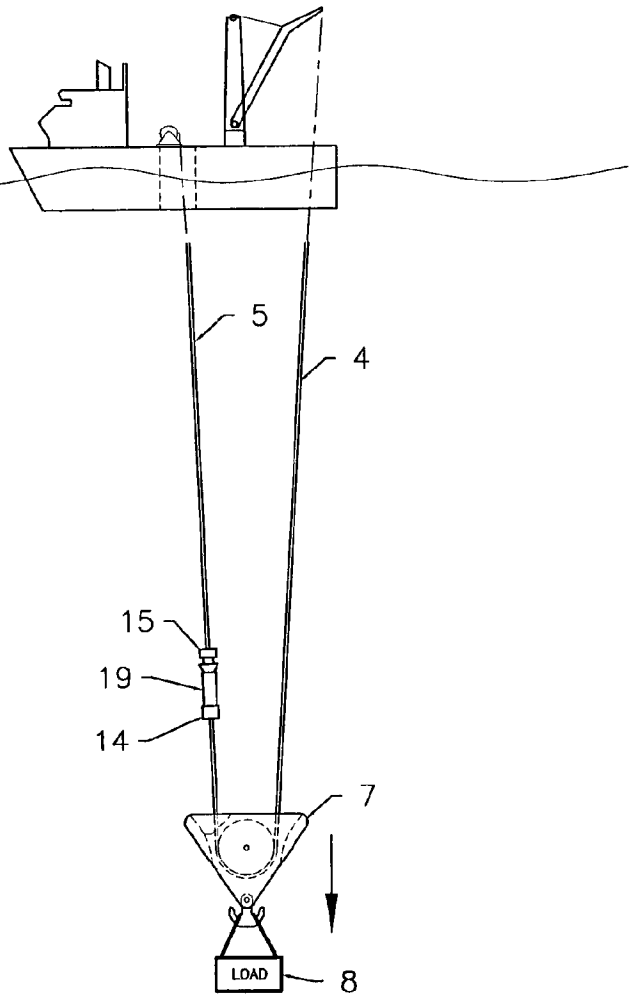
Figure 3C:
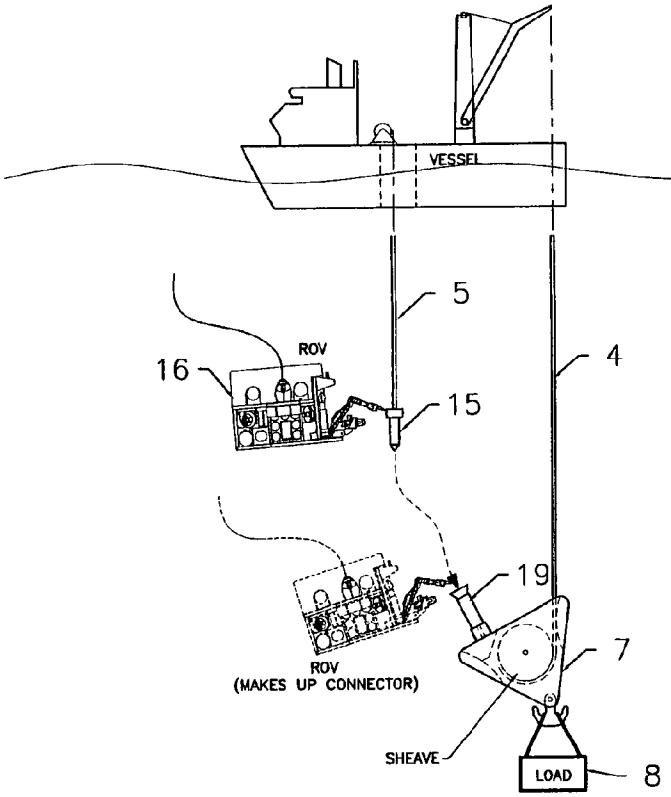

Since the connection has to be made in deep water the connection elements 15, 19 are preferably connectable (mateable) by a remotely operated vehicle (ROV) 16 as illustrated in FIG. 3C. The ROV can be controlled for carrying out subsea operations in the vicinity of the vessel in response to control signals given from on board the lift vessel itself, or another support vessel.

Whilst the two lifting devices, or hoists, are described above as cranes and A&R facilities, the two lifting devices involved can be a combination of cranes and/or A&R facilities and/or other types of hoist, any of which can be operated over the ship's stern, side or through a moon pool.

The lifting wires extending from the crane(s) and/or A&R winches can be widely separated on the vessel thereby minimising the possibility of the first and second lifting wires becoming entangled, for example by twisting around one another. This separation is possible because the crane boom can be used to move the load clear of the vessel's sides or stern, and the A&R wire can be fed down through a moon pool as illustrated in FIG. 1A or FIG. 3B, 3C or 3D.

Figure 4B:
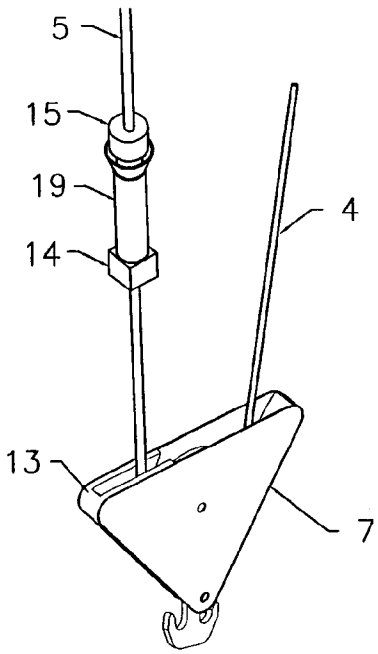
FIG. 4A shows details of a wire load equalising arrangement for a single fall crane lifting arrangement and FIG. 4B shows a three-dimensional detail.
Figure 4A:
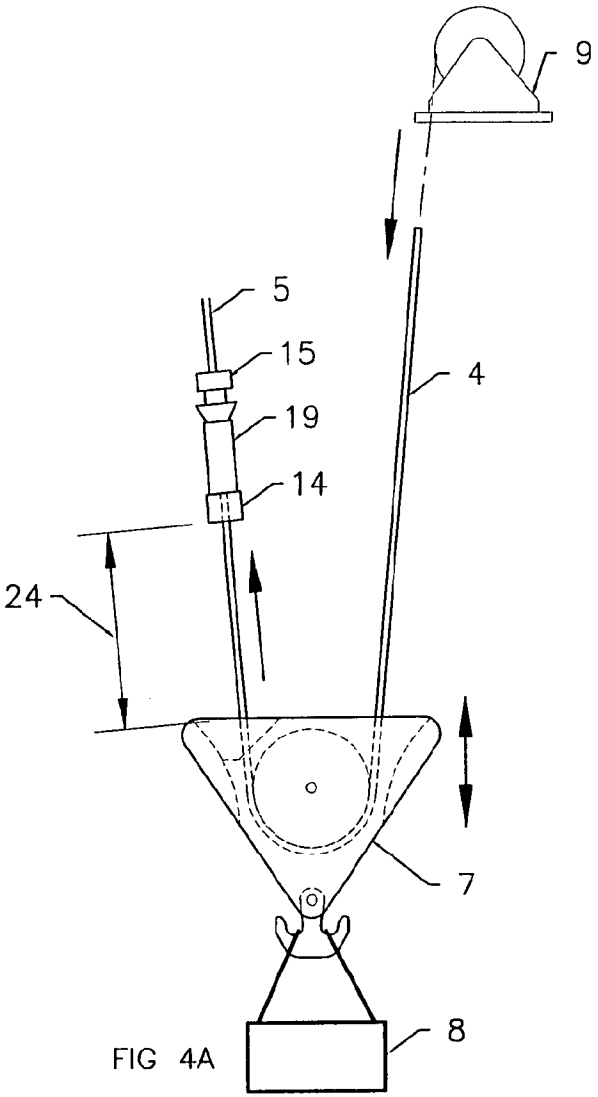

Once the second lifting wire, via the second connection element 15, has been attached to the first connection element 19, by the ROV as indicated in FIG. 3C, the deployed length of the first and second lifting wires is adjusted so that the wire end stop 14 is at an equilibrium position clear of the upper face of the lifting block 7, as shown in FIG. 3D. This ensures that rotation of the sheave 10 is not constrained and thus that it can move as necessary to equalise the load in the two lifting wires, as illustrated in FIGS. 4A and 4B. In practice the separation gap 24 between the end stop 14 and the lifting block 7 will be a safe distance which prevents contact and unwanted load transfer to a single lifting device, and be of the order of 25 to 50 metres, for example.

Both lifting devices can then be operated simultaneously, paying-out at the same rate to facilitate speedy deployment to the final depth, and conversely reeling-in during recovery.

With the arrangement proposed, the heave compensation capability of the crane 2 is retained, and can be used to attenuate the effect of ship movement on the load. It is important to note however that, because the crane wire 4 passes around the DSLB sheave 10 and back to a fixed point on the vessel, via the second wire (A&R winch wire) 5, the crane lift mode has effectively changed from single to double fall (FIG. 3D). Hence any corrective movement supplied to the crane wire 4 will need to be doubled to produce the required compensation. This may necessitate an increase in the spooling speed and/or the length of wire wound in or paid out by the heave compensation system, in order to achieve the necessary response.

Figure 9:
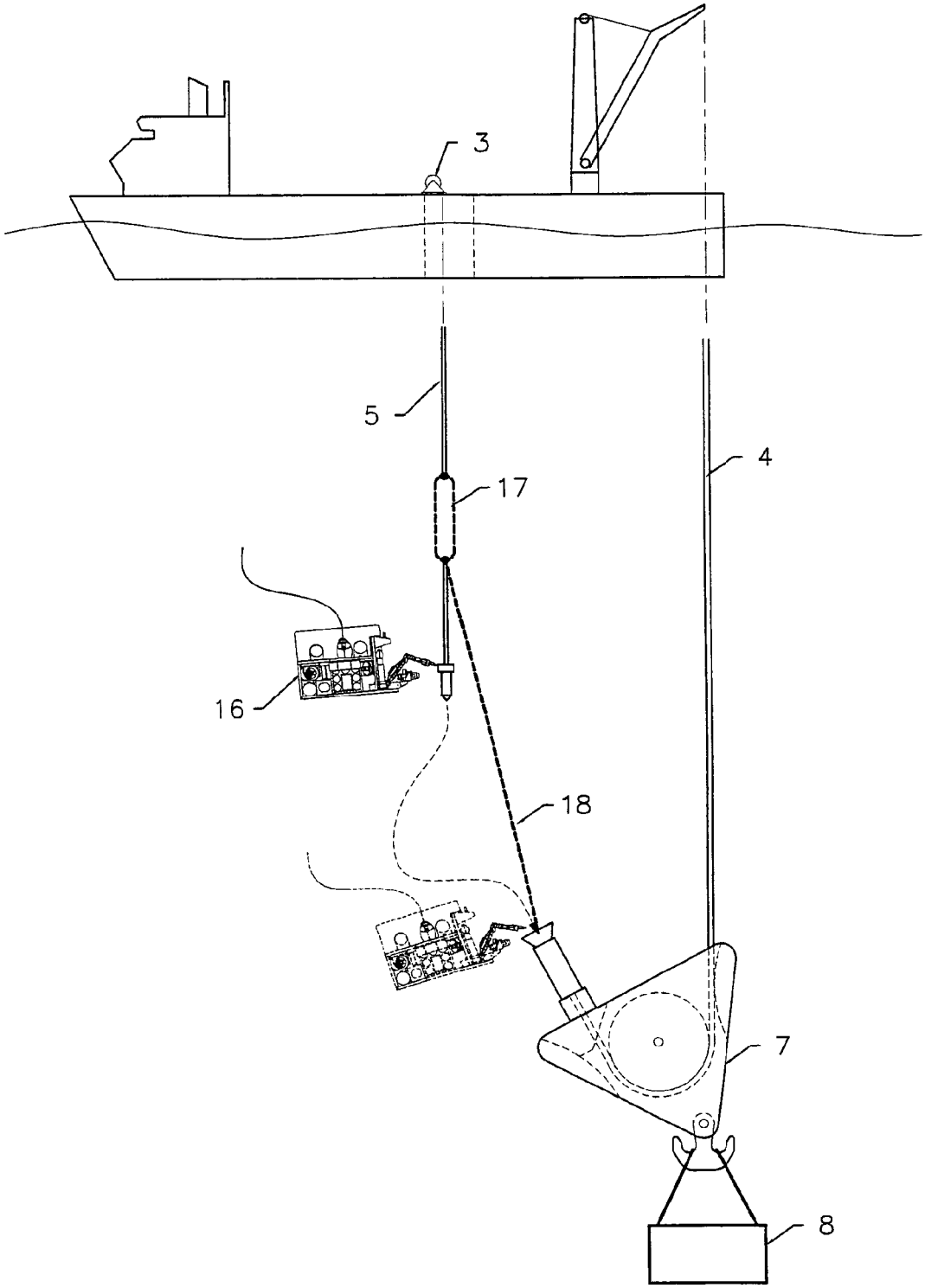
FIG. 9 shows various operations in the use of a lifting block, single fall first lifting arrangement, employing a strop and heave compensator optional arrangements.

In FIG. 9 there is shown a self-contained heave compensation system 17, that is a passive heave compensation device, which can be attached to a hook carried by the second lifting wire 5. This provides the second lifting wire with a heave compensation capability separate to that of the crane, which then only has to compensate for crane displacement.

The separation between the end of the second lifting wire 5 and the load has to be such that the second lifting wire can be pulled across to approach the load and the first connection element 19 by the ROV 16 to achieve a connection. This separation is therefore constrained by the thrust available from the ROV. To overcome/minimise this limitation: (a) The over-boarding position of the second lifting wire 5 can be moved closer to the crane. Once the connection is made it can be moved away as/before the load descends. (b) A neutrally buoyant strop 18 can be attached to (pre-installed to) the end of the first or second lifting wire, which the ROV can then take from one to other with minimal thrust. (c) The end of the second lifting wire 5 can be fitted with buoyancy that counterbalances the weight of the end connection 15 and the wire, thus facilitating deployment across to the load by the ROV.

The construction of the lifting block, DSLB, 7 will be large and heavy, commensurate with the size of lifting wires involved, and this will facilitate lowering/raising of the block when unloaded, without hanging up on the wires or overturning etc.

The sequence of events illustrated in FIGS. 3A to 3D is as follows:

The lifting block 7, with the first lift wire 4 in place fed around its sheave 10 and terminated in the end stop 14, is affixed to a load 8 on the vessel 1, and the load picked up by operation of the crane 2, FIG. 3A, and lowered overboard to a predetermined minimum depth at which it is possible to connect the second lifting wire 5 (FIG. 3B). The depth may be determined by the angle at which the second lifting wire must pass through the moon pool 6, where used, in order to avoid contact with its bottom edge.

The second lifting wire with the second connection element 15 connected is lowered overboard until it is at the required attachment depth (FIG. 3B). The ROV 16 then takes the second connection element (male connector half) 15 across to the DSLB 7, and mates with the first connection element 19 (female connector half) (FIG. 3C).

The load is then taken up by the second lifting device 3 (FIG. 3D) and shared between the two lifting devices, the wire stop 14 being set to be clear of the lifting block 7 in order to allow the load on the two lift wires to equalise. For this the lifting wire of the first lifting device is further paid out until there is a safe distance between the connection and the block, as described above, and subsequently the lifting devices are operated simultaneously, also as described above, that is in unison.

The advantages provided by the use of lifting block 7, lifting wire end stop/first connection element 14, 19, and second connection element 15 combination particularly arise from the fact that existing vessel equipment is used to extend the crane depth range. It particularly avoids the use of long pennant wires, winches, and hang off stops, and wire twist/entanglement is avoided by wide separation of the two lifting devices on the vessel. Operational times and costs are reduced as no extra wires, winches and wire handling is involved.

Figure 5B:
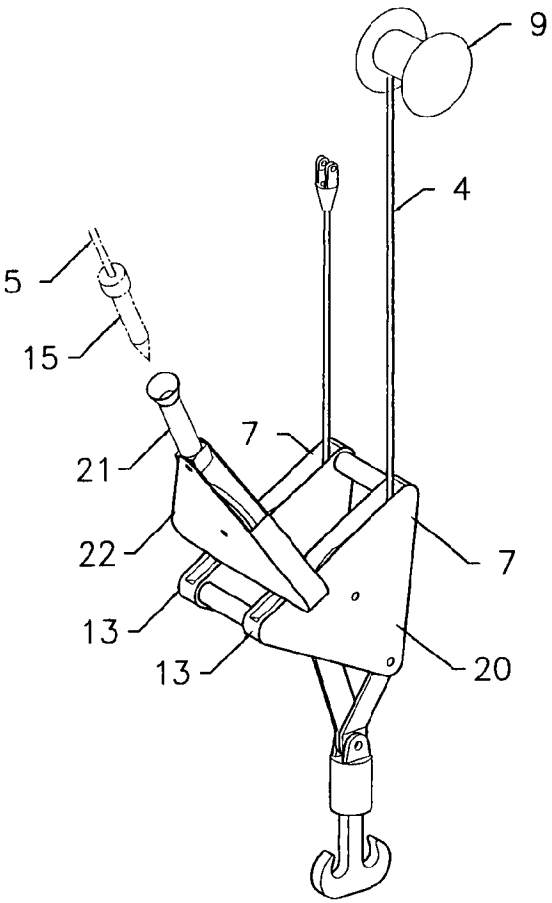
FIG. 5B shows a three-dimensional view thereof.
Figure 5A:
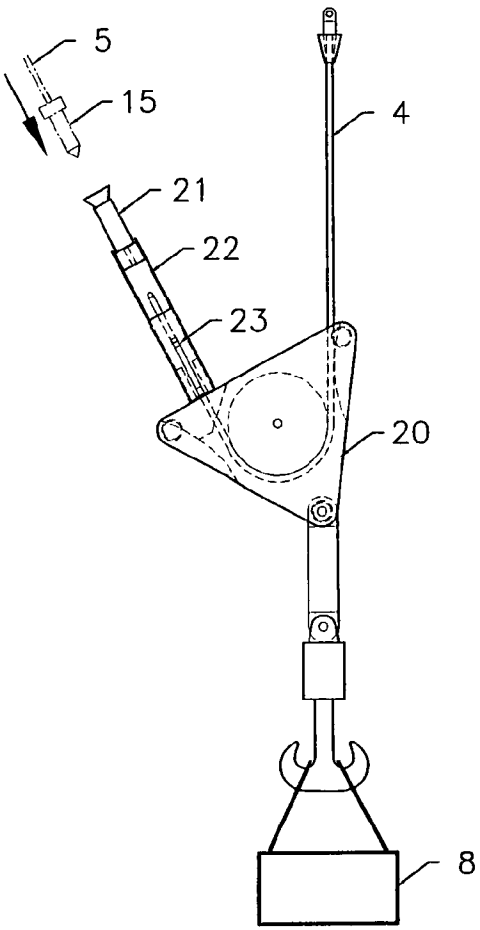
FIG. 5A shows a lifting block and connection elements for a twin fall crane lifting arrangement.
Figure 6:
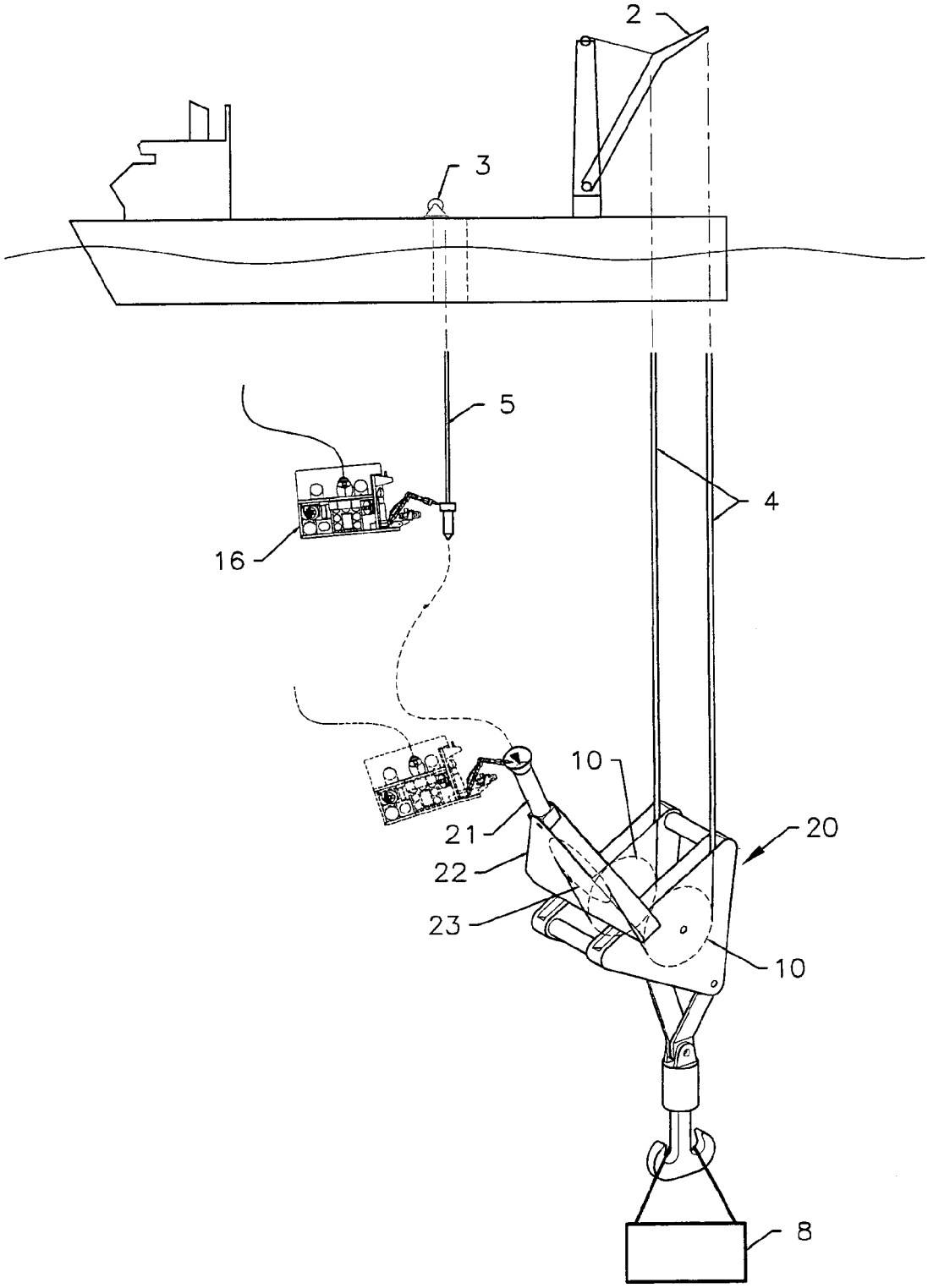
FIG. 6 shows operations in connection with hooking up a second lifting device, that is the A&R winch wire, to the lifting block of the twin fall arrangement type.

Whereas the above description is concerned with a single fall version, illustrated in FIGS. 5A and 5B is a twin fall lifting block 20 comprising two lifting blocks 7 each having a respective sheave 10 and mounted in a spaced apart arrangement as is particularly apparent in FIG. 5B. A first connection element 21 is mounted on an additional block 22 having a respective sheave 23. In this case the first connection element 21 does not act as an end stop for the crane wire (first lifting wire 4), rather the first lifting wire passes around the sheave 10 of one of the Pair of lifting blocks 7, around the sheave 23 of the additional block 22 and round the sheave 10 of the other of the pair of lifting blocks 7 and back up to the crane where it is terminated and fixed to the crane boom. This is particularly apparent from FIG. 6, 7A, 7B and 8.

Figure 7B:
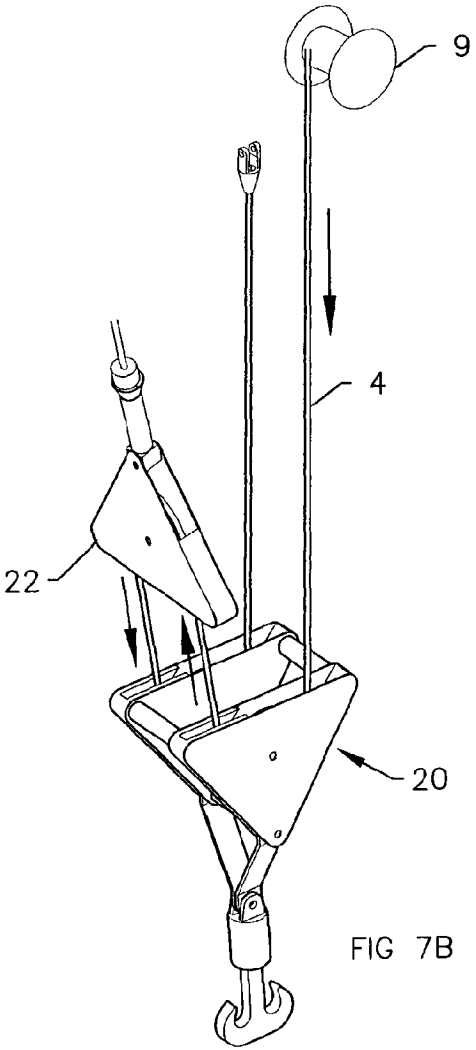
FIGS. 7A and 7B show respectively details and a three-dimensional view of an arrangement with a twin fall first lifting device with wire load equalising.
Figure 7A:
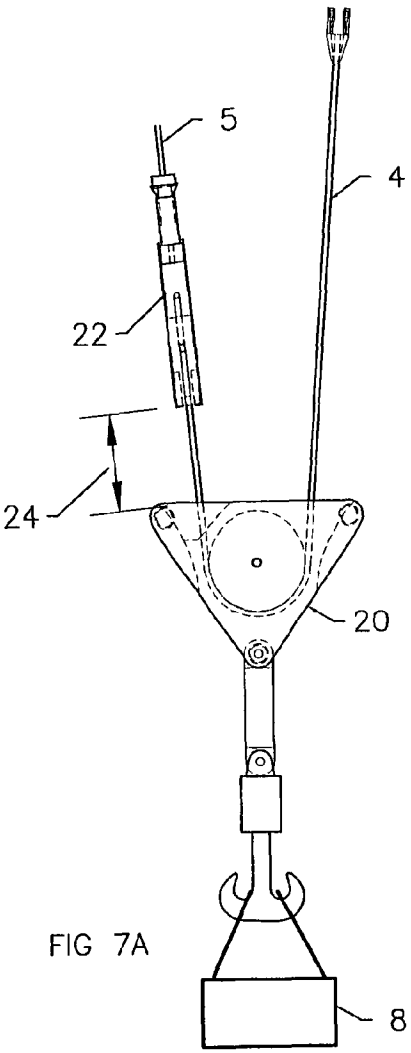
Figure 8:
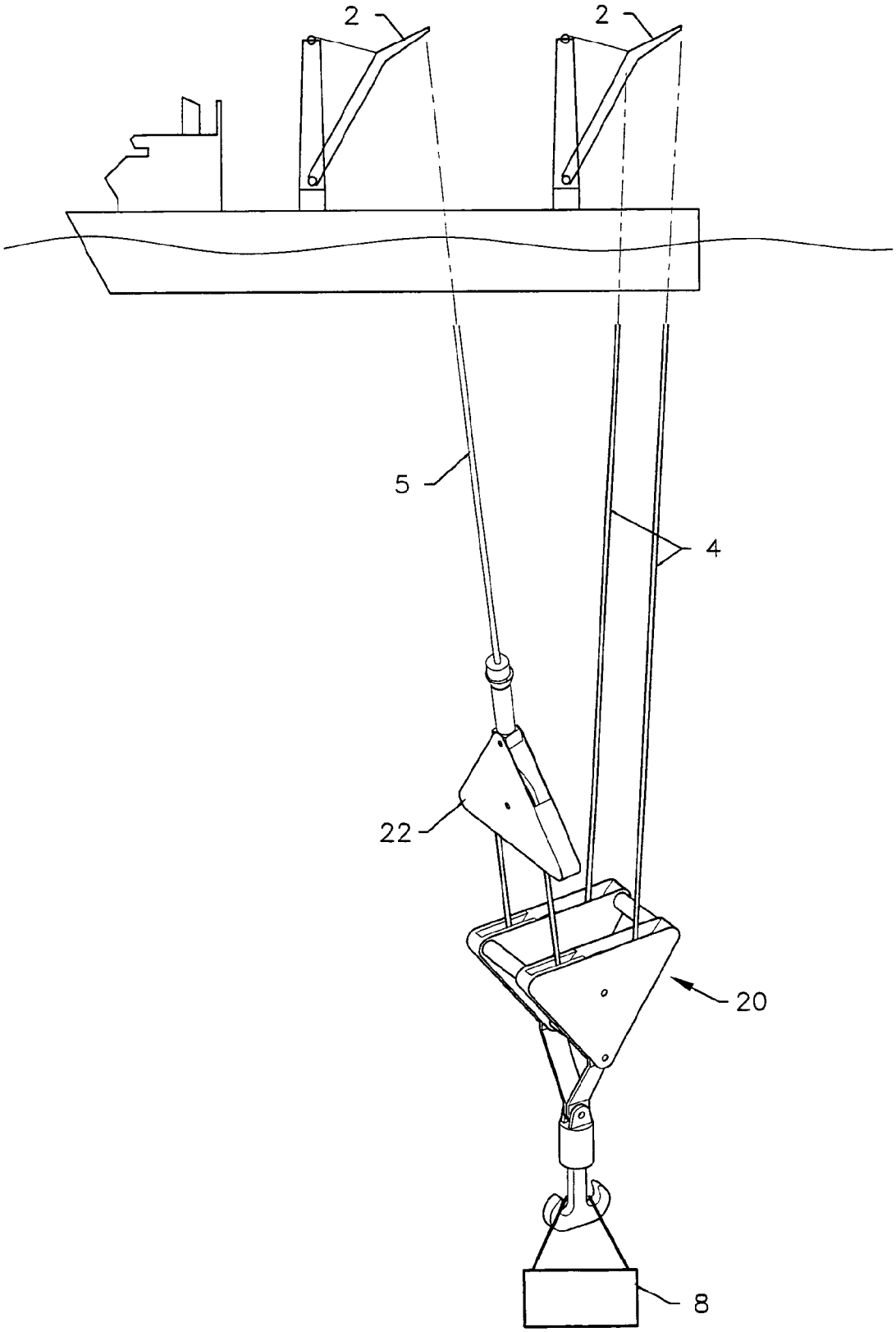
FIG. 8 shows schematically employment of a lifting block for a twin fall first lifting device and employing two cranes on a vessel.

The additional block 22 bears against the sheave block shoulders 13 of both lifting blocks 7 when the load is suspended solely by the crane lift wire 4. Hence the additional block 22 acts as the stop 14 used in the single fall arrangement As in the case of the single fall arrangement, an ROV 16 is used to make the connection between the two connection elements, and subsequently the two lifting devices, which are both illustrated in FIG. 8 as cranes 2, are operated to take up the load and equalise it with the additional block 22 spaced apart from the lifting block 20 (FIGS. 7A, 7B, 8). The method of use of the twin fall arrangement is substantially the same as that described for the single fall arrangement, as are the advantages provided thereby.

As stated above: The rated capacity of a crane (whatever the number of falls) is the allowable load applied to the crane boom by the sum of the loads in the lifting wires. In the case of the twin fall arrangement, the load applied to the crane boom is therefore equal to the weight of the load lifted plus the weight of the twin lifting wires between the boom and the load. These two weights added together should not therefore be allowed to exceed the rated capacity of the crane. From this it is possible to calculate the maximum depth that can be safely attained by a twin fall crane of known capacity and wire weight.

For example: If the nominal rated capacity of the twin fall crane ($W_c$) is 400 tonne, the lifting wire weight ($W_w$) is 40 kg/metre, and the load handled is 200 tonne ($W_L$), then the load at the crane boom at depth $D_{1max}$ (metres)=the crane wire weight $\{=2\times40\times D_{1max}\}$+the load weight (=200×1000)=(400×1000) kg max. From this the maximum depth ($D_{1max}$)=$\{(400-200)\times1000]\div2\times40=2500$ m.

If at this point the weight of the suspended load can be shared with another lifting system, then the effective weight of the suspended load acting on the crane boom is halved. And $D_{2max}$ now $=[(400-(200/2)\}\times1000]\div2\times40=3750$ m.

This gives an increase in operating depth of 1250 m. The weight of the additional wire in the two legs being 2×40×1250=100000 kg=100 tonne—i.e. (as for the single fall configuration described above), equal to the reduction in the load acting on the crane boom due to the additional lift provided by a second hoist.

Again, in very general terms: the maximum working depth of a multi-fall lift system $D_{max}=\{(W_c-(W_L)\}\div N\times W_w$ where N=the number of cable falls. Again it can be seen that a reduction in $W_L$—e.g. by sharing the load with an additional hoist—gives an increase in the maximum allowable depth. In this case the increase being equal to the resulting reduction in the load on the crane boom divided by the primary hoist wire weight per unit length times the number of falls.

Whilst the above description covers the case of loads taken off the deck of the vessel, it is equally applicable to A&R types of operation. For an abandonment type of operation the first wire will be attached to a pipe at deck level and dropped to a predetermined level at which the second wire is added. For a recovery type of operation both the first and second wires will be attached to the pipe on the sea bed and used to lift the pipe until at the predetermined level when the second wire can be removed and the pipe lifted by the first lifting device alone.

In the single fall arrangement the first lifting wire 4 is terminated in the lifting wire end stop 14, which comprises one end of an element whose other end provides a first connection element 19. The end stop 14 rests/is supported on/bears against the sheave block shoulder 13 and effectively secures the end stop 14 to the lifting block 7 when the first lifting device is operated alone.

In the twin fall arrangement the first lifting wire 4 is terminated back on (secured back at) the crane boom after having passed around the two sheaves of the block 20 and the one sheave of the additional block 22, thus effectively securing the additional block and the first connection element to the block 20 when the first lifting device is operated alone.

In both cases, the first connection element is effectively supported on the lifting block by the lifting wire of the first lifting device, whereby a load attached to the lifting block can be raised or lowered by the first lifting device alone.

Figure 7C:
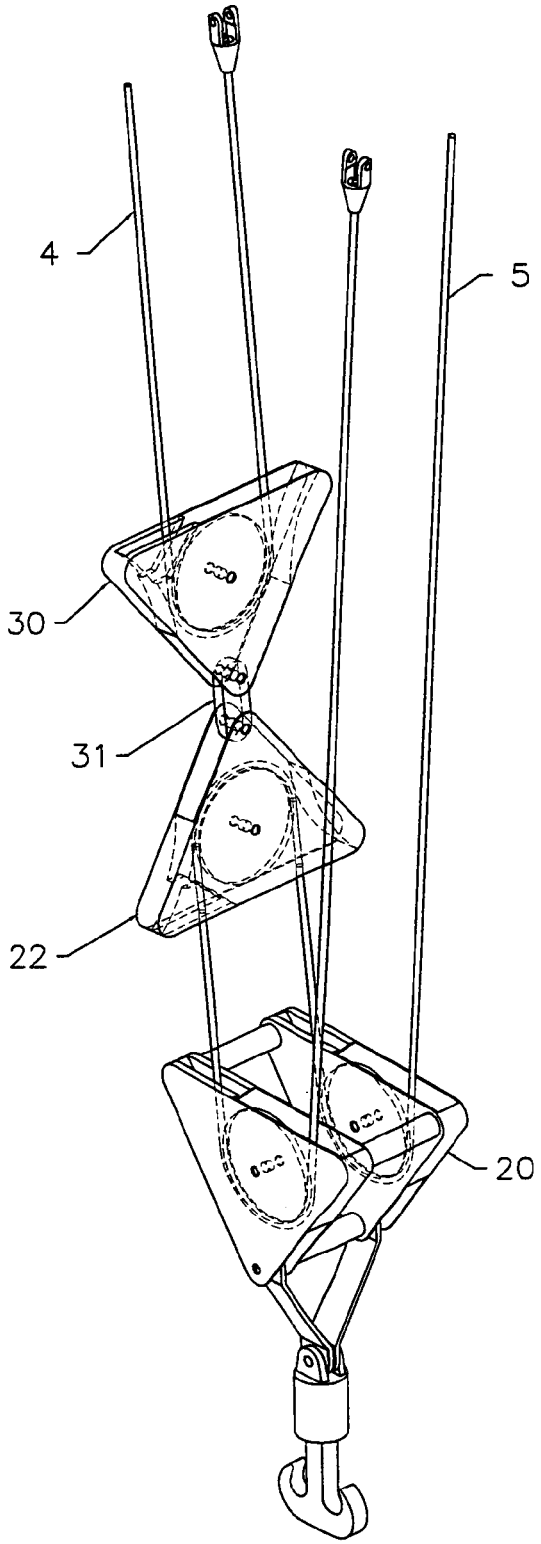
FIG. 7C shows a three dimensional view of an arrangement with a twin fall first lifting device and a twin fall second lifting device.

Whereas FIGS. 5A, 5B, 6, 7A, 7B and 8 are concerned with a combination of a twin fall first lifting device and a single fall second lifting device, another possibility is a combination of a twin fall first lifting device and a twin fall. second lifting device with a lifting block arrangement as illustrated in FIG. 7C. The additional block 22 is in this case connected to a further block 30 around a sheave of which the lifting wire of the second lifting device is passed and is secured back at the second lifting device. There is a connection 31 between the blocks 22 and 30 formed between first and second connection elements and which is for example operable by an ROV. The second connection element is carried by the further block 30 in this case. The twin fall second lifting device is particularly provided by an A&R winch in twin fall mode.

The primary aim of using the A&R winch in twin fall mode is to increase the overall lifting capacity available to the construction vessel by utilisation of the DSLB. This is because this configuration doubles the contribution to the lift which is available from an A&R winch of given load capacity. Because it makes no difference to the load experienced by the crane boom, the depth extension of the crane system remains the same as that obtained when a single fall A&R system contributes to the lift. Whereas, of course, a twin fall A&R winch halves the depth range available from a given maximum length of wire stored on the winch drum. This 2×2 fall DSLB is therefore more concerned with increasing the overall available lift capacity of a construction vessel, than with increasing the depth range of the vessel crane. Depending on the configuration used, the overall lift capacity when using DSLB becomes: Crane wire capacity×number of falls+A&R wire capacity×number of falls.

The method of use is essentially the same as described for a single fall A&R winch.

The load is lifted overboard by the crane, and lowered to a predetermined depth.

The A&R winch is rigged as a twin fall unit, and its block 30 also lowered to a predetermined depth.

By suitably manoeuvring the crane, and/or use of a fibre strop/pennant an ROV is able to connect the A&R block 30 to the crane block 22 (not the DSLB 20).

By adjusting the crane and A&R wires, the crane block 22 is moved a safe distance up from the DSLB 20, and the load is then lifted/lowered by operating the crane and A&R winch in unison.

As for other DSLB configurations, this 2×2 fall arrangement could also be attached to a load already on the sea bed for manoeuvring it to a new location as required.

Whilst the invention has been particularly described with reference to cranes and A&R winches it is not to be considered as restricted thereto and may involve other lifting and load holding devices. The second lifting device could even be a static pennant that is connected to the lifting block at a predetermined depth, and instead of wires it is also applicable to use with synthetic fibre ropes.

The invention claimed is:

1. A method for use in supporting a load, comprising the steps of:

providing a lifting block and first and second connection elements;

supporting the first connection element on the lifting block by means of a lifting wire or rope of a first lifting device disposed around a sheave of the lifting block so that a load attached to the lifting block can be raised or lowered by the first lifting device alone;

attaching the load to the lifting block, whereby the first connection element bears against the lifting block;

operating the first lifting device to cause the load to reach a predetermined level;

attaching the second connection element to a lifting wire or rope of a second lifting device and causing the second connection element to approach the first connection element;

joining the first and second connection elements;

supporting and sharing the load between the first and second lifting devices with the first connection element clear of the lifting block; and operating the first and second lifting devices in unison to dispose the load at a required position.

2. The method according to claim 1 for supporting a said load from a floating vessel, wherein the first and second lifting devices are spaced apart on the vessel, the predetermined level is at a first depth under the vessel, and the required position is at a greater depth than the first depth.

3. The method according to claim 2, including, following the joining step, the step of adjusting the lengths of the lifting wires or ropes of the first and second lifting devices to cause a predetermined displacement between the lifting block and the first connection element.

4. The method according to claim 1, wherein the first lifting device is a single fall device and the lifting block includes a sheave, and including the steps of feeding the lifting wire or rope of the first lifting device around the sheave and terminating the lifting wire or rope of the first lifting device to the first connection element which, when the load is lifted by the first lifting device alone, forms an end stop which bears against the lifting block.

5. The method according to claim 4, wherein the end stop bears against cheek plates of the sheave.

6. The method according to claim 1, wherein the first lifting device is a twin fall device and the lifting block has first and second sheaves and the first connection element has a respective sheave, wherein the lifting wire or rope of the first lifting device is fed around the first sheave of the lifting block, around the respective sheave of the first connection element, around the second sheave of the lifting block and secured back at the first lifting device, and wherein when the load is lifted by the first lifting device alone the first connection element bears against the lifting block.

7. The method according to claim 6, wherein the first connection element bears against cheek plates of both the first and second sheaves of the lifting block.

8. The method according to claim 7 wherein the second lifting device is a twin fall device and comprises a further lifting block around a sheave of which the lifting wire or rope of the second lifting device is passed and is secured back at the second lifting device, and wherein the second connection element is carried by the further lifting block.

9. The method according to claim 2, including the step of disposing a heave compensator in the lifting wire or rope of the second lifting device.

10. The method according to claim 2, wherein the first and second connector elements are joined by use of a remotely operated vehicle, ROV.

11. The method according to claim 10, further including the step of disposing a neutrally buoyant strop, which is pre-installed on the lifting wire or rope of the second lifting device, between the lifting wire or rope of the second lifting device and the first connector element by the ROV prior to said joining step whereby to facilitate operation of the ROV for said joining step.

12. The method according to claim 3, wherein the first lifting device is a twin fall device and the lifting block has first and second sheaves and the first connection element has a respective sheave, wherein the lifting wire or rope of the first lifting device is fed around the first sheave of the lifting block, around the respective sheave of the first connection element, around the second sheave of the lifting block and secured back at the first lifting device, and wherein when the load is lifted by the first lifting device alone the first connection element bears against the lifting block.

13. A lifting block system comprising a lifting block, a first connection element and a second connection element, wherein the lifting block is configured to support a load from a first lifting device alone or from the first lifting device and a second lifting device together, wherein the first connection element is attachable to a lifting wire or rope of the first lifting device, wherein the lifting block further comprises a sheave such that when the lifting wire or rope is fed around the sheave an end stop of the first connection element bears against the lifting block when the load is supported by the first lifting device alone, the first connection element is connectable to the second connection element, and wherein the second connection element is attachable to a lifting wire or rope of the second lifting device, such that when the first connection element is connected to the second connection element the load is supported by the first and second lifting devices together such that the end stop of the first connection element is moveable clear of the lifting block by movement of the lifting wire or rope of the first lifting device around the sheave.

14. The lifting block system according to claim 13, wherein for a single fall first lifting device the lifting bock includes a single sheave and the first connection element is adapted to terminate the lifting wire or rope of the first lifting device, which is fed around the sheave, and form an end stop adapted to bear against the lifting block when the load is supported by the first lifting device alone.

15. The lifting block system according to claim 14, wherein the lifting block includes cheek plates associated with the sheave and the end stop is adapted to bear against the cheek plates when the load is supported by the first lifting device alone.

16. The lifting block system according to claim 13, wherein for a twin fall first lifting device the lifting block includes first and second sheaves and the first connection element has a respective sheave, wherein in use the lifting wire or rope of the first lifting device is fed around the first sheave of the lifting block, around the respective sheave of the first connection element, around the second sheave of the lifting block and secured back at the first lifting device, and wherein the first connection element of the twin fall first lifting device is adapted to bear against the lifting block when the load is supported by the first lifting device alone.

17. The lifting block system according to claim 15 wherein the first connection element of the twin fall first lifting device is adapted to bear against cheek plates of both the first and second sheaves of the lifting block.

18. The lifting block system according to claim 16, wherein the second lifting device is a twin fall device and comprises a further lifting block around a sheave of which in use the lifting wire or rope of the second lifting device is passed and secured back at the second lifting device, and wherein the second connection element is carried by the further lifting block.

19. The lifting block system according to claim 13 wherein the first connection element comprises a female connector for engagement with a male connector comprising the second connector element carried by the lifting wire or rope of the second lifting device or a further lifting block respectively.

20. The lifting block system according to claim 18 wherein the first connection element comprises a female connector for engagement with a male connector comprising the second connector element carried by the lifting wire or rope of the second lifting device or the further lifting block respectively.

* * * * *